United States Patent [19]

Dittert et al.

[11] 4,164,813

[45] Aug. 21, 1979

[54] ELECTRICALLY POWERED KNIFE

[75] Inventors: Karl Dittert, Schwäbisch Gmünd; Hans W. Hartkorn, Munich, both of Fed. Rep. of Germany

[73] Assignee: Ritterwerk GmbH, Munich, Fed. Rep. of Germany

[21] Appl. No.: 875,068

[22] Filed: Feb. 3, 1978

[30] Foreign Application Priority Data

Feb. 9, 1977 [DE] Fed. Rep. of Germany ..... 2705419

[51] Int. Cl.[2] ..... B26B 7/00

[52] U.S. Cl. ..... 30/272 A

[58] Field of Search ..... 30/272 A, 272 R

[56] References Cited

U.S. PATENT DOCUMENTS 2,726,689 12/1955 Busby ..... 30/272 R 2,945,298 7/1960 Guttmann ..... 30/272 A 3,203,095 8/1965 Nelson ..... 30/272 A

*Primary Examiner*—Robert Louis Spruill

*Assistant Examiner*—J. T. Zatarga

*Attorney, Agent, or Firm*—Sughrue, Rothwell, Mion, Zinn and Macpeak

[57] ABSTRACT

An electrically powered knife has a handle with projecting removable knifeblades driven from a drive unit containing an electric motor, the drive unit being readily disconnectable from the handle so that this can be cleaned without risk of damage to the motor. A switch controlling motor operation is located in the drive unit but is operated from the handle by a mechanical link or a Bowden cable extending from a push button to an end surface of the handle to engage a switch member at an adjacent surface of the drive unit.

10 Claims, 6 Drawing Figures

3
21
20
19
5
6
17
1
18
16
2
4
8
5
7
6
11
12
13
15
14
III
III 1
3
21
20
19
14
22

ELECTRICALLY POWERED KNIFE

BACKGROUND OF THE INVENTION

An electrically driven knife known from U.S. Pat. No. 3,203,096 comprises a casing constituted as a handle which contains gear means and to one end of which movable knifeblades can be connected. At its other end, the casing has a drive unit containing an electric motor, and at the end of the casing adjacent the blades, there is a control button connected to an electric switch for switching on the electric motor. In this known knife the blades can be unlocked and removed from the handle, but the drive unit is integrally built into the knife handle and there is a danger of damage to the driving unit when the handle is cleaned.

From U.S. Pat. No. 2,945,298, an electrically driven knife is known in what an electric motor and an associated switch are provided in the handle. A drive means with a knifeblade holder is connected to the handle by screws. Removal of the handle with the electric motor from the drive means in normal use of the knife is neither intended nor possible, since upon such removal the drive means is pulled apart and exposed.

The invention has as an object the provision of an electrically driven knife from which the motor can be readily removed to facilitate cleaning of the remaining parts thereof.

The invention also has as an object to provide an electrically powered knife having a casing capabale of being readily sub-divided into a handle portion mounting a control element and a drive unit portion containing a motor controllable by operation of the control element.

Another object of the invention is to provide an electrically driven knife in which the various parts are organised in an improved manner so as to facilitate cleaning thereof.

A further object of the invention is to provide an electrically driven knife in which both the knifeblades and also the driving unit can be released from the handle.

SUMMARY OF THE INVENTION

In an electrically powered knife in accordance with the present invention, a driving unit is connected to a handle portion so that the two can be readily uncoupled, there being a mechanical link between a control element on the handle and a switch controlling energisation of the electric motor in the drive unit.

The mechanical link according to the invention may be a switch rod or a Bowden wire. The use of a Bowden cable is particularly advantageous when the drive unit is located not as a longitudinal extension of the handle but underneath and parallel with it.

With an electric knife in accordance with the present invention, it is possible for the user of the knife to remove both the knife blades and the drive unit from the handle for cleaning. Thorough cleaning of the handle is thus possible without the fear of damage being done to the drive unit. Furthermore, the drive unit may be adapted for use in combination with other appropriately designed kitchen or like machines.

Also in accordance with the invention, the drive unit is advantageously connected to the handle by notched pins and a locking-plate. The notched pins may extend from the handle, whilst the locking-plate is located in the drive unit and may be moved to an unlocked position by a button to permit removal of the driving unit from the handle.

Alternatively, in accordance with the invention, the drive unit may be connected to the handle by a screwthread or by a bayonet joint, a catch mechanism being then advantageously provided between the unit and the handle. Such arrangements have the advantage that the drive unit can be very simply adapted to extend in such a manner that it projects a little way into the handle.

Also in accordance with the invention, the coupling of the electric motor of the drive unit to the drive or gear means in the handle is advantageously effected by way of a square sectioned sleeve on the driving shaft and a corresponding recess in the handle. The drive or gear means comprises a mechanism which moves the two knifeblades in opposite directions to and fro along their longitudinal axes.

DETAILED DESCRIPTION OF PREFERRED EMBODIMENTS

Figure 1:
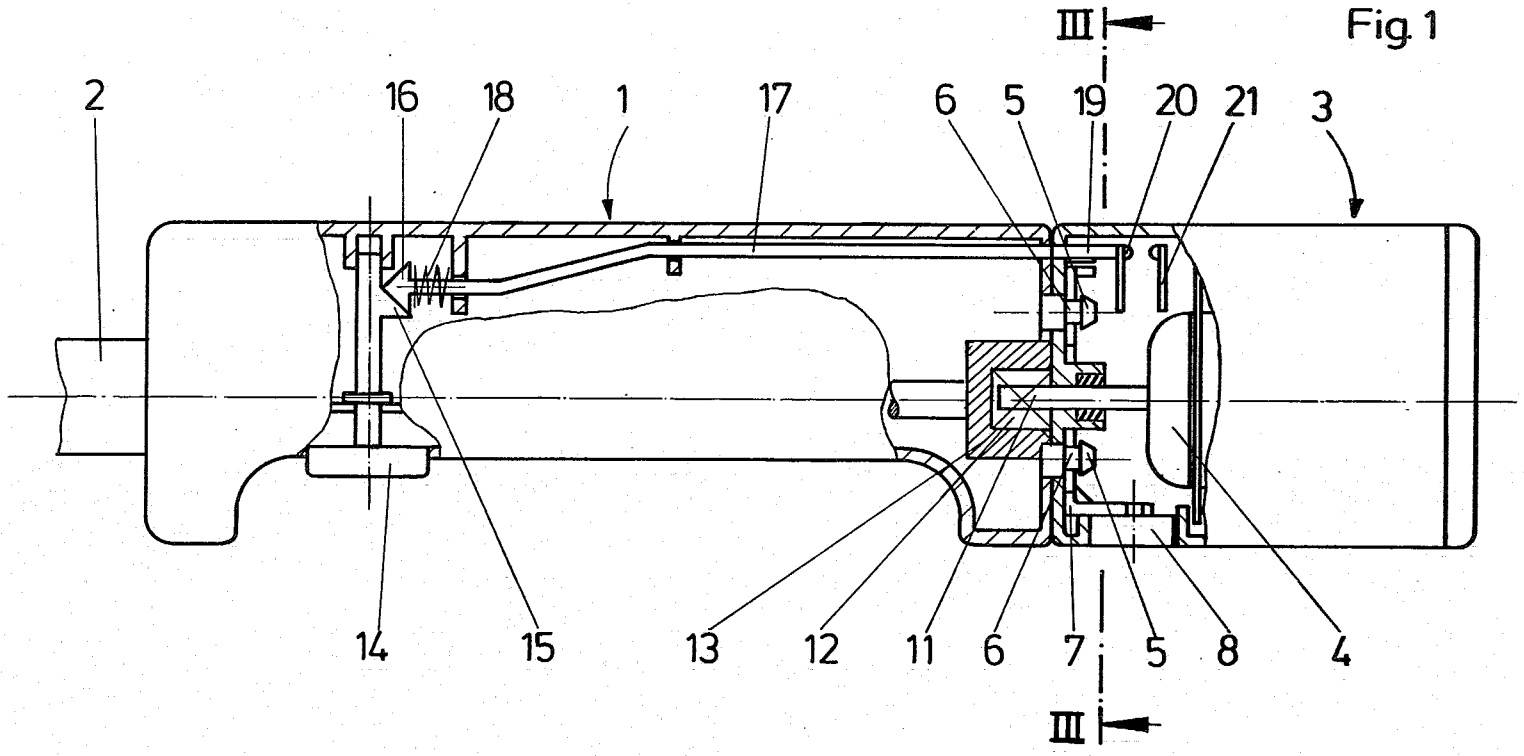
FIG. 1 is a side elevation partly in section of a handle of an electrically driven knife embodying the invention, showing a drive unit coupled to the handle on the longitudinal axis thereof.

In the handle of an electrically driven knife illustrated in FIG. 1, two knifeblades 2 are received side by side at the front end of the handle; only one of the knifeblades can be seen. A drive unit 3 with an electric motor 4 for driving the knifeblades is coupled to the rear end of the handle 1 and forms an axially extending longitudinal continuation of the handle.

Three notched pins 5 each having a recess 6 rearwardly of a tapered free end extend from the rear end of the handle 1. Within the drive unit 3, a locking plate 7 is adapted to slide adjacent a parallel to the front end face of the unit. The plate 7 is connected to a release button 8 and is urged into the locking position by a leaf spring 9. The shape and function of the locking plate 7 best appear from FIG. 3.

The plate is provided with an aperture 10 for each pin 5, the apertures having first portions through which the free ends of the pins can pass and adjoining portions having edges which engage in the recesses 6 as shown to lock the handle 1 and the drive unit 3 together.

Figure 3:
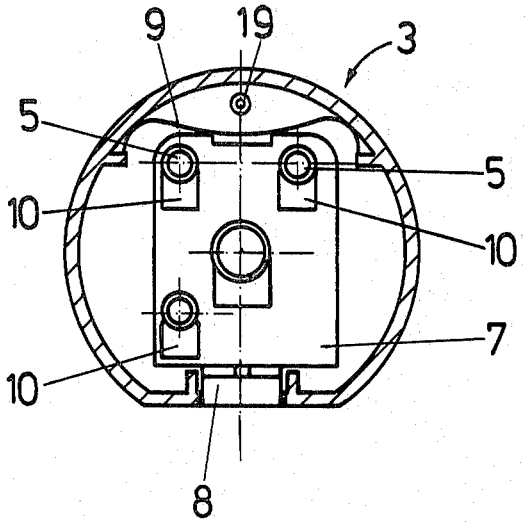
FIG. 3 is a cross-sectional view through the drive unit of FIG. 1 taken on the line III—III of FIG. 1.

It may also be seen from FIG. 3 that the three notched pins 5 are arranged asymmetrically so that the drive unit 3 must always be coupled to the handle 1 in a clearly defined position. By depressing the unlocking button 8 the apertures 10 in the locking plate 7 are shifted so that the pins 5 find themselves in the first portions of the apertures, so that the drive unit 3 may be removed from the handle 1 by relative displacement of the unit and the handle in the direction of the common longitudinal axis thereof.

The electric motor 4 in the driving unit 3 has a driving shaft 11 projecting beyond the front end face of the unit. A clutch element in the form of a polygonally sectioned sleeve 12, preferably a sleeve square of cross-section is seated on this driving shaft 11. The sleeve 12 is detachably received in a correspondingly shaped dog 13 in the handle 1 which constitutes the other clutch element. The dog 13 is in driving connection with transmission or driving arrangements in the handle 1, which may be conventional and are therefore not shown. The driving arrangements bring about a reciprocating motion of the knifeblades 2, the knifeblades moving in opposed directions at any given time.

A return button 14 is provided at the front end of the handle 1, which operates by way of an oblique slider 15 on a cam or wedge-shaped extension 16 of a switch rod 17. The switch rod 17 extends to the rear end of the handle 1. As long as the button 14 is depressed, the switch rod 17 is held in a position in which it projects out of the rear end of the handle 1. On release of the pressure on the button 14, a spring 18 acting between the extension 16 and the handle 1 causes withdrawal of the switch rod 17 to a position substantially flush with the rear end of the handle and the extension moves the button 14 to the limit position shown.

A switch pin 19 is slidably guided in the drive unit 3 at a position such that when the drive unit is coupled onto the handle 1, the switch pin extends coaxially to the switch rod 17. When the button 14 is depressed, the switch rod 17 abuts the switch pin 19 and causes this to act on a movable switch-contact 20 so that this in turn is moved to engage a fixed switch-contact 21. The two switch-contacts 20 and 21 constitute a switch for controlling energisation of the electric motor 4 of the driving unit 3. The electric supply is brought to the motor of the drive unit 3 from a supply socket by means of a plug and cable (not shown).

By means of the mechanical arrangements including the switch rod 17 and the switch pin 14, the motor 4 can be controlled from the handle 1 without the need for electrical connections between the handle and the drive unit 3.

Figure 2:
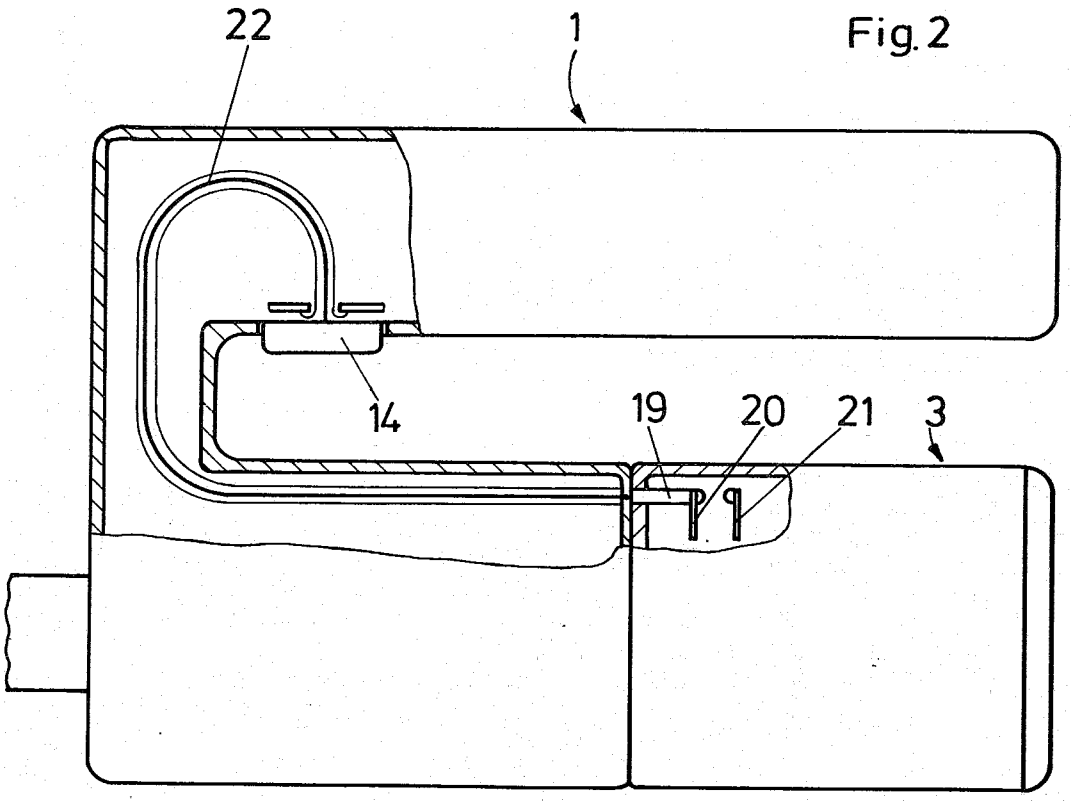
FIG. 2 is a side elevation partly in section of a handle of a second electrically driven knife embodying the invention showing a drive unit coupled to the handle underneath it and so as to extend parallel to the longitudinal axis of the handle.

FIG. 2 shows a modified form of the handle 1 to which the driving unit 3 is coupled so as to extend parallel to the longitudinal axis of the handle and below it. Instead of the switch rod 17 co-operating with the slider 15 on the release button 14, a Bowden cable 22 is provided in this modified handle. The Bowden cable 22 extends from the release button 14 to the switch pin 19 of the movable switch-contact 20 in the driving unit 3. Here again the release button 14 is pressed in against the force of a return spring (not shown) to actuate the switch constituted by the switch contacts 20 and 21, in order to switch on the electric motor 4 of the driving unit 3.

Figure 4:
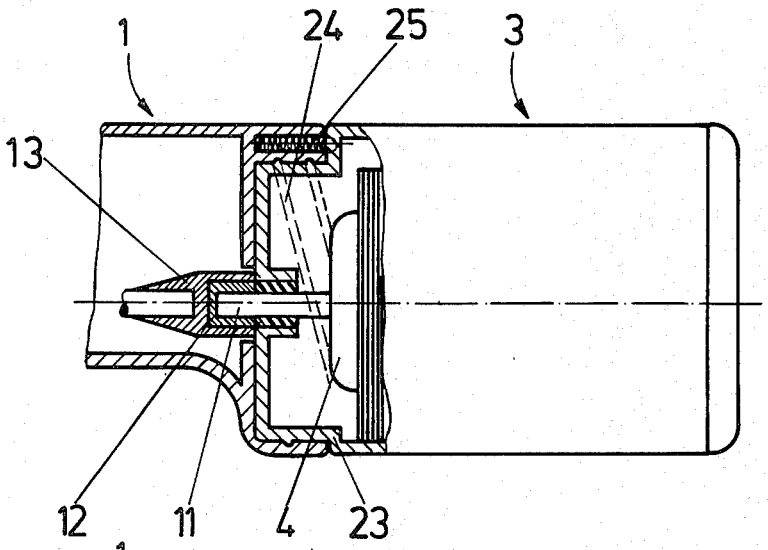
FIG. 4 is a side elevation partly in section of a modified unit connected to a modified handle by means of multiple screwthreads.

FIG. 4 shows another form of coupling mechanism for the handle 1 and the driving unit 3. On a reduced diameter extension 23 of the driving unit 3 a multiple screwthread 24 is provided. The extension 23 can be screwed by means of this screwthread 24 into a recess formed at the rear end of the handle 1 and having a corresponding screw tapping.

Furthermore, a spring detent or catch mechanism 25 is provided, which ensures that the driving unit 3 cannot come loose in service unintentionally, as because of vibration. When the driving unit 3 is screwed in or out, the resistance of the catch mechanism 25 is easily overcome by manual force. This mechanism has the advantage of providing more room for the drive unit 3 with otherwise similar proportions since the drive unit in the coupled condition is partly received in the handle 1.

Figure 5:
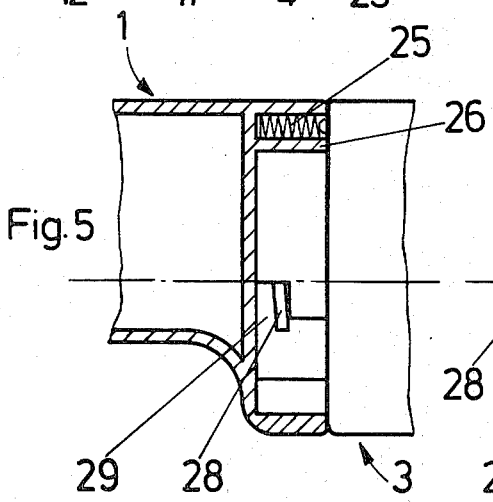
FIG. 5 is a partial side elevation partly in section of a further modified drive unit connected to a further modified handle by means of a bayonet joint.
Figure 6:
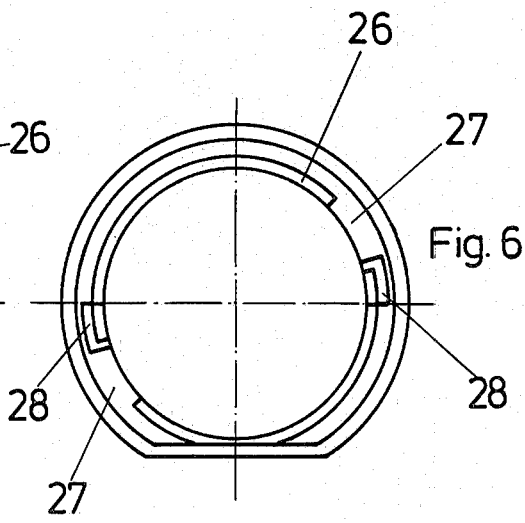
FIG. 6 is an end view of the coupling region of the handle of FIG. 5 with the drive unit disconnected.

FIGS. 5 and 6 show a drive unit 3 which is coupled to the handle 1 by means of a bayonet joint. Here too a catch mechanism 25 is provided. At the rear end of the handle 1, a guide-sleeve 26 is formed. Through clearances 27 in the guide-sleeve 26, locking lugs 28 on the drive unit 3 are introduced axially beyond the guide-sleeve 26 and twisted so that each locking lug 28 engages behind the guide sleeve in a corresponding recess 29. The catch mechanism 25 again ensures that the driving unit 3 does not become unintentionally loose.

In each of the coupling mechanisms described in connection with FIG. 3 and FIGS. 4 and 5, a mechanical link is preferably provided between a control element such as the button 14 on the handle 1 and a switch means for controlling energisation of the motor 4 in the drive unit 3. Although neither is shown, the switch rod 17 or the Bowden wire 22 could be employed in the embodiment of FIG. 3 or that of FIGS. 4 and 5. The position of the switching rod 17 or the Bowden wire 22 could be displaced in the radial direction from the positions shown in FIGS. 1 and 2 to avoid the catch mechanism 25.

It is evident that the foregoing disclosure will enable those skilled in the art to make numerous other uses and modifications of and departures from the embodiments specifically described herein without departure from the spirit and scope of the present inventive concepts. The present invention is accordingly to be construed as embracing each and every novel feature and novel combination of features herein disclosed and as being limited solely by the scope and spirit of the appended claims.

We claim:

1. An electrically powered knife device comprising
first casing means,
electric drive motor means in said first casing means,
switch means in said casing means operable to control energisation of said drive motor means,
second casing means shaped as a handle,
knifeblade means,
transmission means in said second casing means adapted to apply a drive from said electric drive motor means to drive said knifeblade means,
switch control means on said second casing means, and
means releasably coupling said first casing means with said second casing means, said electric drive motor means with said transmission means, and said switch means with said switch control means.

2. The device of claim 1 wherein said coupling means comprises mechanical means coupling said switch means with said switch control means.

3. The device of claim 2 wherein said mechanical means comprises a switch rod and press-button means causes longitudinal switch-operating movement of said switch rod.

4. The device of claim 2 wherein said mechanical means includes a Bowden cable in said second casing means.

5. The device of claim 1 wherein said coupling means comprises a plurality of notched pins projecting from said second casing means and apertured locking-plate means carried by said first casing means for movement between a first position in which said pins can extend freely through said apertures and a second position in which said pins are held by engagement of edges of said apertures into said notches.

6. The device of claim 1 wherein said coupling means include screwthread connection means operative between said first and said second casing means.

7. The device of claim 6 further comprising releasable detent means operative to define a predetermined angular relationship between said first and second casing means.

8. The device of claim 1 wherein said coupling means comprises bayonet joint means operative between said first and second casing means.

9. The device of claim 1 wherein said coupling means comprises clutch means operative between said electric drive motor means and said transmission means.

10. The device of claim 1 wherein said second casing means is elongate, said knifeblade means comprises a pair of blades removably carried by said transmission means to extend from one end of said second casing means, said first casing means comprises a longitudinal continuation of the other end of said second casing means, said transmission means has an input shaft and is adapted to convert rotation of said input shaft into opposed phase reciprocating movement of said blades, said switch control means comprises a button movable transversely of the second casing means and link means operable by movement of said button to project from said second casing means, and said coupling means comprises clutch means located generally axially of said casing means, said clutch means releasably connecting the drive motor means output shaft with said transmission means input shaft, connecting means located between the axis of said first and second casing means and the exterior thereof and adapted to connect said first and second casing means, and a switch pin having a first end in operative relation with said switch means and a second end located for abutment by said link means.

* * * * *